US007886496B1

(12) United States Patent
Spransy

(10) Patent No.: US 7,886,496 B1
(45) Date of Patent: Feb. 15, 2011

(54) EXTRUDED ALUMINUM BOTTOM-LOAD CEILING

(75) Inventor: Peter J. Spransy, Salt Lake City, UT (US)

(73) Assignee: DAW Technologies, Inc., Salt Lake City, UT (US)

( * ) Notice: Subject to any disclaimer, the term of this patent is extended or adjusted under 35 U.S.C. 154(b) by 122 days.

(21) Appl. No.: 12/194,317

(22) Filed: Aug. 19, 2008

Related U.S. Application Data

(60) Provisional application No. 60/965,415, filed on Aug. 20, 2007.

(51) Int. Cl.
*E04B 9/18* (2006.01)
*E04B 9/00* (2006.01)

(52) U.S. Cl. ..... 52/506.06; 52/220.6; 52/506.07; 52/506.1

(58) Field of Classification Search ..... 52/220.6, 52/506.06, 506.07, 506.08, 506.09, 506.1
See application file for complete search history.

(56) References Cited

U.S. PATENT DOCUMENTS

| | | | | | |
|---|---|---|---|---|---|
| 876,985 | A | | 1/1908 | Malançon | |
| 3,261,625 | A | | 7/1966 | Cripe | |
| 3,333,387 | A | | 8/1967 | Deakins | |
| 3,451,183 | A | * | 6/1969 | Lespagnol et al. | 52/656.1 |
| 3,559,357 | A | | 2/1971 | Lowe | |
| 3,596,425 | A | * | 8/1971 | Kodaras | 52/665 |
| 3,733,759 | A | | 5/1973 | Schulte et al. | |
| 3,748,793 | A | | 7/1973 | Tompkins et al. | |
| 3,832,816 | A | | 9/1974 | Jahn | |
| 3,837,128 | A | * | 9/1974 | O'Brien | 52/241 |
| 3,884,002 | A | | 5/1975 | Logie | |
| 3,989,399 | A | | 11/1976 | Slowbe | |
| 4,047,342 | A | | 9/1977 | Boulva | |
| 4,094,113 | A | | 6/1978 | Good | |
| 4,128,983 | A | | 12/1978 | Matsubara | |
| 4,299,067 | A | | 11/1981 | Bertschi | |
| 4,545,168 | A | | 10/1985 | Dalton, Jr. | |
| 4,944,129 | A | * | 7/1990 | Hartleif | 52/506.08 |
| 5,077,951 | A | * | 1/1992 | Baker | 52/506.07 |
| 5,154,031 | A | * | 10/1992 | Wall | 52/506.06 |
| 5,363,625 | A | | 11/1994 | Philippi | |
| 5,428,930 | A | * | 7/1995 | Bagley et al. | 52/506.07 |
| 5,444,945 | A | * | 8/1995 | Goodwin | 52/65 |
| 5,482,240 | A | * | 1/1996 | Caraher | 248/297.51 |
| 5,572,844 | A | | 11/1996 | Stackenwalt et al. | |
| 5,634,312 | A | | 6/1997 | Tolliver et al. | |
| 5,687,527 | A | * | 11/1997 | Bikard et al. | 52/506.08 |

(Continued)

OTHER PUBLICATIONS

Photograph of a ceiling system marketed prior to applicants' priority date.

(Continued)

*Primary Examiner*—Khoi Tran
*Assistant Examiner*—Jason Holloway
(74) *Attorney, Agent, or Firm*—Madson IP, P.C.

(57) ABSTRACT

An extruded aluminum bottom-load ceiling used in conjunction with cleanrooms comprises main tees and cross tees with removable flanges. The tees are connected via cam-lock devices or splice bars and may be hung on a 4'×4' or 8'×8' configuration. The tees also include hammerhead-nut slots used to suspend the tees from the building structure above and hang AMHS hangers from the tees. Grid stiffeners are included to increase the carrying capacity of the tees.

15 Claims, 9 Drawing Sheets

U.S. PATENT DOCUMENTS

| | | | | |
|---|---|---|---|---|
| 5,794,397 | A * | 8/1998 | Ludwig | 52/506.08 |
| 6,123,154 | A * | 9/2000 | MacDonald et al. | 169/37 |
| 6,125,606 | A * | 10/2000 | Larsson | 52/836 |
| 6,158,186 | A * | 12/2000 | Feller | 52/506.06 |
| 6,511,522 | B1 * | 1/2003 | Gomez et al. | 55/385.2 |
| 6,779,315 | B1 * | 8/2004 | Bongio et al. | 52/506.07 |
| 6,789,977 | B2 | 9/2004 | Layfield | |
| 6,811,130 | B1 * | 11/2004 | Oh | 248/343 |
| 7,260,919 | B1 * | 8/2007 | Spransy et al. | 52/586.1 |
| 7,287,733 | B2 * | 10/2007 | Bongio et al. | 248/235 |
| 2003/0213199 | A1 * | 11/2003 | Bongio et al. | 52/506.01 |
| 2010/0130055 | A1 * | 5/2010 | Liang et al. | 439/532 |

OTHER PUBLICATIONS

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

* cited by examiner

EXTRUDED ALUMINUM BOTTOM-LOAD CEILING

RELATED APPLICATIONS

This application is related to and claims priority from U.S. Provisional Patent Application Ser. No. 60/965,415 filed Aug. 20, 2007, for an Extruded Aluminum Bottom-Load Ceiling for Cleanrooms with Mechanism for Hanging Attachments, with inventor Peter J. Spransy which is incorporated herein by this reference.

TECHNICAL FIELD

The present invention relates to cleanroom ceilings. More specifically, it relates to cleanroom ceiling suspension systems from which you can drop a ceiling from a ceiling structure and suspend the ceiling with an interstitial space between the structure above and the bottom-load ceiling system.

BACKGROUND

Extruded aluminum ceilings are widely used in cleanrooms that perform semiconductor manufacturing processes. In such a ceiling, extruded aluminum members, shaped as inverted "tee"s, are hung from the building structure above, thus forming an interstitial space in between the ceiling and the building structure.

Main tees and cross tees are usually configured in a 2'×4' or 4'×4' layout. Fan Filter Units (FFUs), blank pans, and lighting units then rest on the flanges of the tees. In addition, current cleanroom ceilings are generally required to carry the additional burden of Automated Material Handling Systems (AMHS) hung from below the ceiling grid.

Unlike conventional ceilings, which are quite static, cleanroom ceilings are in a constant state of change. Thus, the ceilings in cleanrooms must be easily configurable in order to adapt to changing needs.

One particular problem in current ceilings is that equipment, due to its size and weight, must sometimes be installed from below. This often forces installers to work at awkward angles to enable the equipment to pass through the grid before being leveled and lowered onto the grid. If the interstitial space is limited due to ductwork or the structure above, it may be impossible to install the equipment from below in the manner described.

Another requirement is that the ceiling be sufficiently strong to support the necessary equipment and allow maintenance personnel to move within the interstitial space to install and maintain equipment such as FFUs. A ceiling must also be strong enough to support AMHS hangers from below.

Most existing extruded aluminum ceilings are suspended on a 4'×4' hanger layout in order to provide this type of strength. This, however, is expensive because of the number of hanger rods or anchoring rods required. It is also restrictive of the interstitial space and may present problems when installing mechanical ductwork and piping.

The speed and consequent expense of the installation and reconfiguration of extruded aluminum ceilings are overriding considerations in the cleanroom context. It is advantageous to supply a ceiling at an affordable price. It is equally important that the maintenance or installation not unnecessarily delay the operation of a cleanroom. Semiconductor prices are volatile and time sensitive. As such, interruptions or delays in the manufacturing process can be devastating. Thus, the speed of installation and reconfiguration is directly linked with the expense of the ceiling.

Another important aspect of ceilings is the number of parts involved in installation. Parts inventory can be very costly. If pieces are late or missing the entire installation process can come to a standstill. This is amplified in a cleanroom where every part must be wiped down (cleaned) prior to entering the cleanroom.

Accordingly, a need exists for an extruded aluminum ceiling that is easily configurable, sufficiently strong, and affordable and easy to install.

SUMMARY OF THE INVENTION

The present invention has been developed in response to the present state of the art, and in particular, in response to the problems and needs in the art that have not yet been fully resolved by currently available extruded aluminum ceilings.

The bottom-load ceiling is an extruded aluminum gasket tee bar ceiling. The pre-assembled cross tees are connected to the main tees using a cam-lock device that quickly locks the cross tees into position with a half turn of a cone point set screw at each end of each cross tee. The cam-lock ceiling connection reduces the time to install the present invention to approximately ⅓ of the time it takes to install a comparable cleanroom ceiling. In this way, the ceiling is easily configurable. In addition, it reduces the number of necessary parts as it utilizes parts common to an existing wall system using the same battens/flanges and closure pieces.

The main tees of the present invention may be hung on 4' centers or on 8' centers. Installing on 8' centers reduces the number of hanger rods or anchoring rods by up to 75%, reducing clutter in the interstitial space and eliminating the associated expense. The ceiling is specifically designed for supporting AMHS below the ceiling grid.

The grid is compatible with the retrofit "Backbone" designed to increase the carrying capacity of the grid. This backbone, or grid stiffener, may be customized for just a portion of the ceiling requiring extra carrying capacity, thus making it more affordable and easily configurable as well as very strong.

The inverted "tee" flanges are removable so filters/FFUs and blank pans may be installed from below without the need of jockeying them through the grid at awkward angles prior to their being set onto the grid. These removable flanges enable installers to more easily, and consequently more affordably, install equipment from below while in a level position.

These and other features of the present invention will become more fully apparent from the following description, or may be learned by the practice of the invention as set forth hereinafter.

BRIEF DESCRIPTION OF THE DRAWINGS

In order that the manner in which the above-recited and other advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
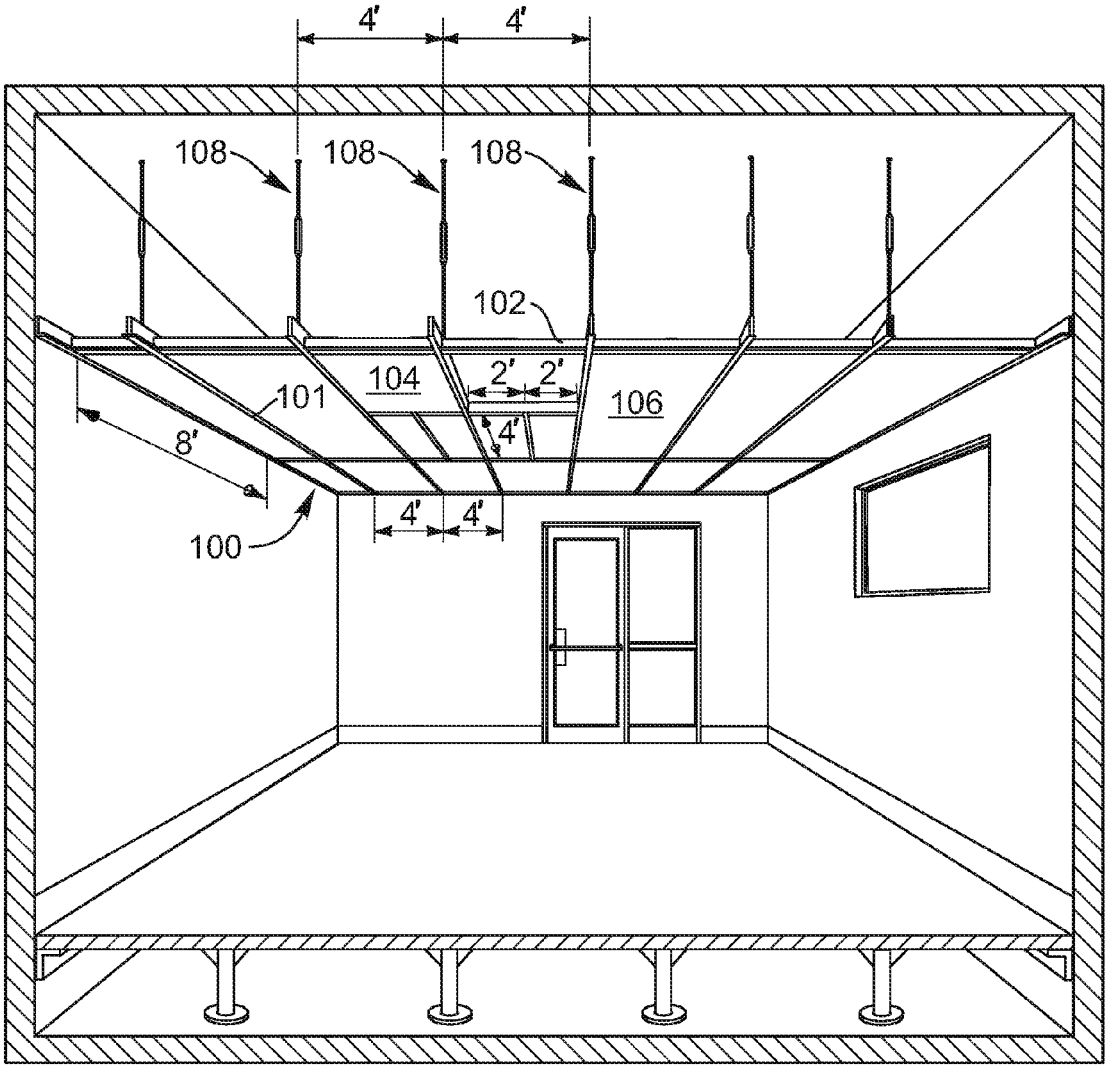
FIG. 1 is a sectional perspective view of a clean room with an embodiment of a bottom-load ceiling suspension system partially assembled.

The present invention may be embodied in other specific forms without departing from its spirit or essential characteristics. The described embodiments are to be considered in all respects only as illustrative and not restrictive. All changes and alternatives that would be known to one of skill in the art are embraced within the scope of the invention.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

The extruded aluminum bottom-load ceiling is an extruded aluminum gasket tee bar ceiling. The pre-assembled cross tees are connected to the main tees using a cam-lock device that quickly locks the cross tees into position with a half turn of a cone point set screw at each end of each cross tee. Main tees may be hung on 4' centers or on 8' centers. The ceiling is specifically designed for supporting AMHS below the ceiling grid.

The grid is compatible with the retrofit "Backbone" designed to increase the carrying capacity of the grid. The inverted "tee" flanges may be removable so filters/FFUs and blank pans may be installed from below without the need of jockeying them through the grid at an awkward angle prior to their being set onto the grid.

The main advantages of the present invention are the removable inverted tee flanges, the cam-lock connection, and the option of supporting the grid on 8'×8' centers.

Having removable flanges permits ceiling installations in existing buildings having limited clearance in the interstitial space, installations having limited clearance can be nearly impossible with a conventional inverted tee grid ceiling. The removable flanges permit installation of the filters/FFUs and blank pans from below without the need of jockeying them through the grid at an awkward angle prior to their being set onto the grid. With the flanges removed the filters/FFUs and blank pans are simply raised into position in a level orientation. The removable flanges speed installation, reduce the possibility of damage to the filters/FFUs being installed and they permit safer installation of these heavy units.

The cam-lock connection is simply a faster connection than those used in existing ceiling systems. Comparable systems might use as many as twelve fasteners and a plate fitting to create the intersection connection. The pre-assembled cross tees of the present invention are connected to the main tees using a cam-lock device that quickly locks the cross tees into position with a half turn of a cone point set screw at each end of each cross tee. The cam-lock ceiling connection reduces the time to install the present invention to approximately ⅓ of the time it takes to install a comparable clean-room ceiling.

Comparable systems to the present invention typically have an "intersection casting". With aluminum castings at 4'×4' centers, it is required that the entire ceiling be supported on 4'×4' centers. This is very costly due to the amount of hardware and time to install. A major issue with the 4'×4' hanger rod scheme is the instances of interference resulting from the vast amount of ductwork and piping typically located in the interstitial space. When a hanger rod is located directly below an existing duct it requires that a trapeze be formed to go around the duct up to the structure above. This adds to the congestion and cost due to additional hardware and time to install. The present invention has a unique connection between main tees that permits the present invention to be suspended at 8'×8' centers. This reduces the congestion and the number of hanger rods by up to 75%.

FIG. 1 is a sectional perspective view of an embodiment of a bottom-load ceiling suspension system 100. The bottom-load ceiling suspension system 100 may include main frame members 101, cross frame members 102, ceiling suspension anchors 108 and ceiling panels 104, 106. The ceiling suspension anchors 108 may be attached to the main frame members 101 and located at 8'×8' intersections. The ceiling panels 104, 106 may rest on panel support ledges of main frame members 101 and cross frame members 102.

In some embodiments, the main frame and cross frame members 101, 102 may be extruded aluminum. The main frame members 101 may attach using splice bars to increase the overall length in a singular direction or create a perpendicular intersection to form a grid. In other embodiments, the main frame and cross frame members 101, 102 may attach using cam-lock devices to create a perpendicular intersection to form a grid.

Figure 2:
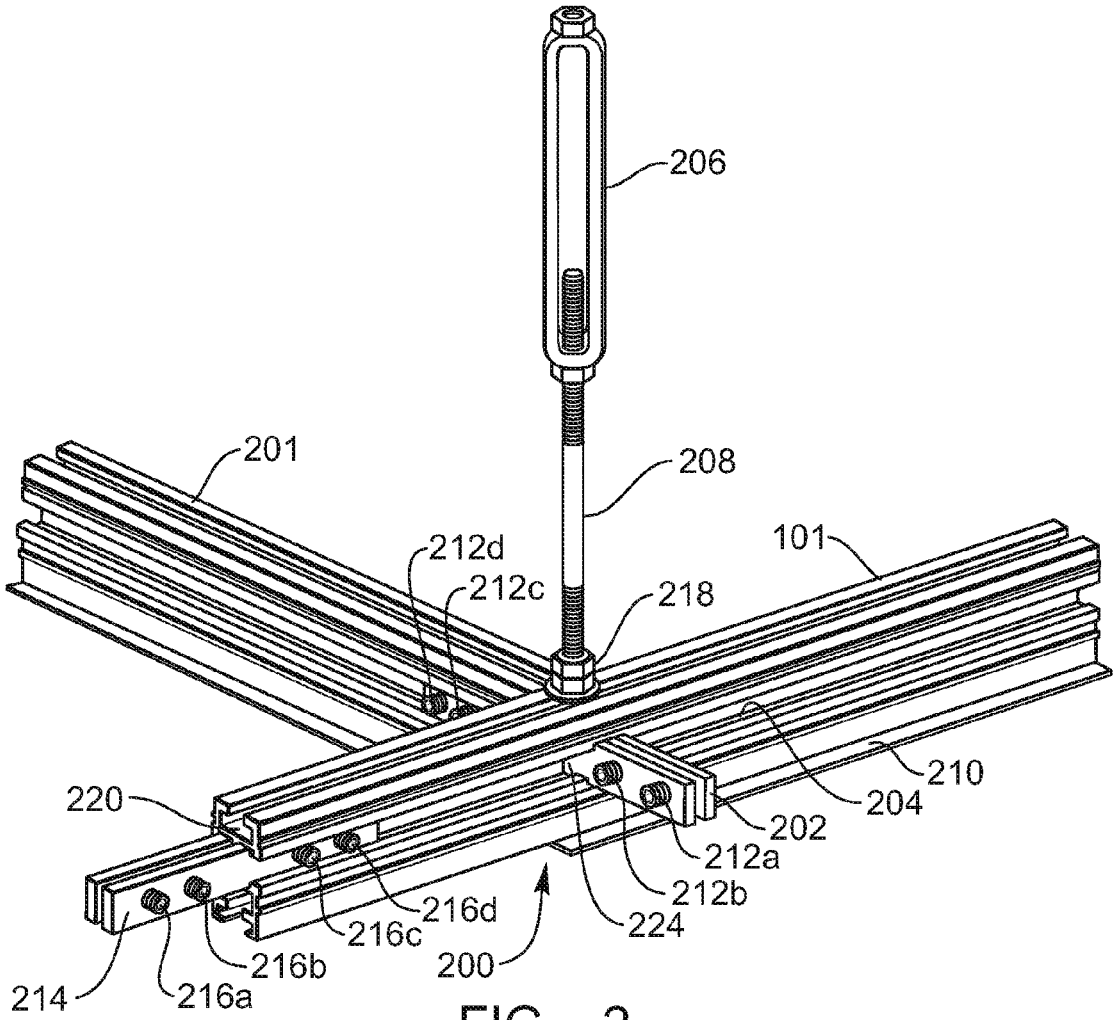
FIG. 2 is a perspective view of one embodiment of an intersection between a first main tee with removable flanges and a second main tee using a splice bar.

FIG. 2 is a perspective view of one embodiment of an intersection 200 between a first main tee 101 with removable flanges 210 and a second main tee 201 using a splice bar 202 inserted through the recessed channel 204. The first main tee 101 and the second main tee 201 may be extruded aluminum members of the bottom-load ceiling. The first main tee 101 may be suspended from the building structure above (not shown) using a hanger bar, a turnbuckle 206, a threaded drop rod 208, and a hex nut 218. The hanger bar (not shown) may be attached to secondary framing of the building structure above (not shown), the bottom of the hanger bar may be attached to the top of the turnbuckle 206. The bottom of the turnbuckle 206 may be attached to the top of another threaded drop rod 208. The bottom of this threaded drop rod 208 may be attached to the first main tee 101 with a hammerhead-nut assembly (see FIG. 11) in the top hammerhead-nut channel 220. Once the main tees and the cross tees have been hung or connected, the turnbuckles 206 may be used to ensure that the grid is level.

Optionally, a first main tee 101 may be extended with the use of a splice bar 214. One half of the splice bar 214 may slide over the stud (see FIG. 9 for a sectional view of a main tee 101) of the main tee 101. The splice bar set screws 216*c*, 216*d* may then be tightened, thus fastening the splice bar 214 first to the main tee 101. Next, the stud of another main tee (not shown) may be slid into the available end of the splice bar 214. The other splice bar set screws 216*a*, 216*b* may then be tightened. In this way, a first main tee 101 may be extended and the splice joint may be staggered or located at a position that need not bear a significant load.

Additionally, a second main tee 201 may be attached to a first main tee 101 with a splice bar 202. The splice bar 202 may be inserted through a hole 224 bored into the web of the first main tee 101. The stud of the second main tee 201 may then be slid into one end of the splice bar 202 where the splice bar set screws 212*c*, 212*d* are tightened. Next, the stud of another main tee (not shown) may be slid into the available end of the splice bar 202 and the splice bar set screws 212*a*, 212*b* are tightened. In this way, the two secondary main tees 201 may be fastened to each other and the first main tee 101 through the use of a splice bar 202, thus forming an intersection of main tees 101, 201 without the use of an intersection piece as is known and used in the art.

Figure 3:
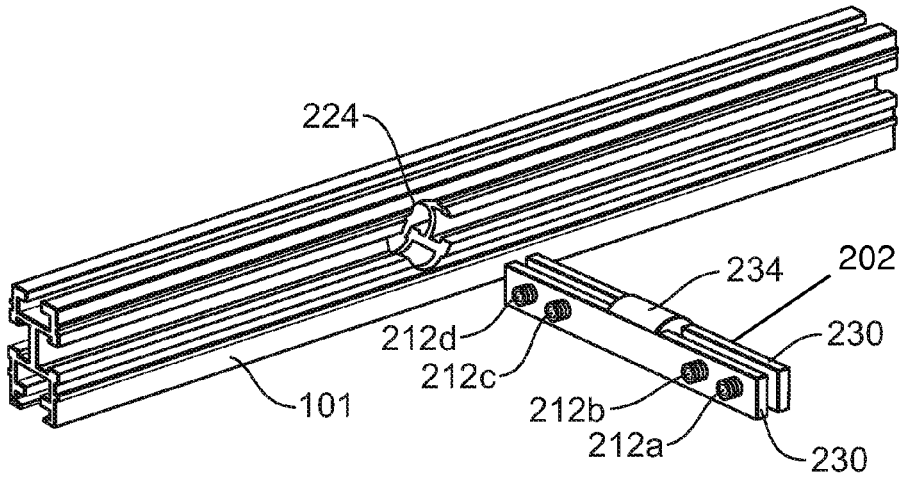
FIG. 3 is a perspective view of an embodiment of an aluminum tee and a splice bar.

FIG. 3 is a perspective view of an embodiment of an aluminum main tee 101 and a splice bar 202. A hole 224 may be bored in the web of a main tee 101 to accept the splice bar 202. A splice bar midsection spacer 234 is disposed between separate plates 230 and may have a rounded top and bottom. This splice bar midsection 234 holds the separate plates 230 in a spaced relationship and has a shape to match and snuggly engage the hole 224. The hole 224 in the web of the main tee 101 may be sized to tightly fit with the splice bar midsection 234. The splice bar 202 has set screws 212*a*, 212*b*, 212*c*, and 212*d* to facilitate attachment to main tees 201 as shown in FIG. 2.

Figure 4:
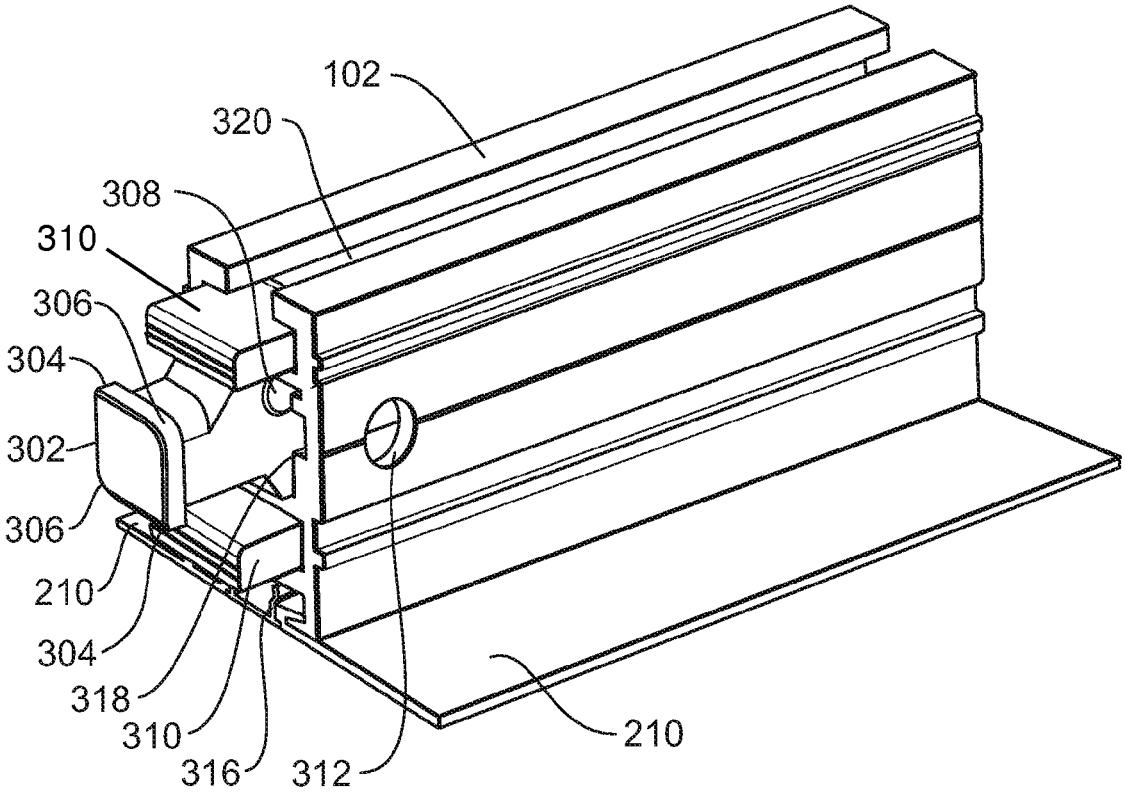
FIG. 4 is a perspective view of an embodiment of a cross tee with a cam-lock device.

FIG. 4 is a perspective view of an end of a cross tee 102 with a cam-lock device 302. The cam-lock device 302 may be inserted into the cross tee 102 midsection receiving chamber 318. A resilient member 308 may be used to act as a spring to ensure that the cam-lock device 302 is in the "open" position when inserting into the receiving chamber 318. The cam-lock device 302 has a hammerhead end with two square corners 304 and two rounded corners 306 to aid in installation associated with FIG. 4. A hole 312 may be bored in the midsection of the cross tee 102 to allow a set screw with a cone point (not shown) to be tightened and loosened. The cam-lock device 302 has an indentation (not shown) and receives the set screw. Additionally, the inside of the midsection receiving chamber 318 opposite the hole 312 may be milled in a conical fashion. Thus, when the set screw, running through the cam-lock device 302, is tightened the cone point of the set screw may be driven to the middle of the milled cone receiving indentation and consequently, the cam-lock device is pulled toward the cross tee 102 and into a secure position. When the set screw is loosened, the cone point is pushed away from the center of the milled cone receiving indentation by the resilient member 308 and consequently allows the cam-lock device 302 to incrementally pull away from the end of the cross tee 102. Stoppers 310 may be placed in the top 320 and bottom (not shown) hammerhead-nut channels of the cross tee 102 in order to securely position the cross tee 102 when installed. A closure strip 316 and removable flanges 210 may be inserted into the bottom recessed slot of the cross tee 102 so that when the ceiling grid is complete, blank pans and equipment may rest on the flanges 210.

Figure 5:
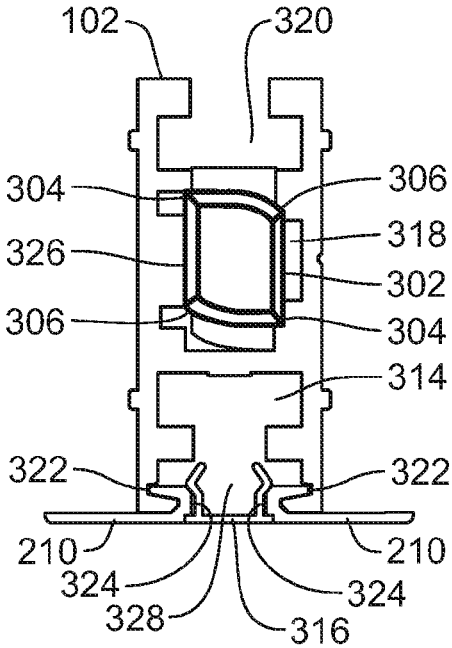
FIG. 5 is an end view of an embodiment of a cross tee with a cam-lock.

FIG. 5 is an end sectional view of an embodiment of a cross tee 102 with a cam-lock 302. The cam-lock 302 may be inserted in the midsection receiving chamber 318 of the cross tee 102. The cam-lock 302 has a hammerhead end with two square corners 304 and two rounded corners 306 to allow the cam-lock 302 to rotate during installation. A receiving indentation may be milled in a conical fashion in a thickened wall 326 in the midsection receiving chamber 318. This conical receiving indentation (not shown) may receive the cone point set screw (not shown). This pulls the cam-lock 302 into the cross tee 102 when the set screw is tightened and allows the cam-lock 302 to incrementally pull away from the cross tee 102 as the set screw is loosened. Stoppers (not shown) may be placed in the top hammerhead-nut channel 320 as well as the bottom hammerhead-nut channel 314 in order to securely position the cross tee 102 when attached to a main tee.

In the present embodiment, removable flanges 210 are inserted into their respective receiving channels 322 in the recessed slot 328. A closure strip 316 may be inserted into the recessed slot 328 to push against the inside walls 324 of the removable flanges 210 to retain the removable flanges 210 in place. The closure strip 316 prevents the removable flanges 210 from moving transversely. The removable flanges 210 may support equipment and blank pans (not shown) placed on them. This is accomplished because the closure strip 316 presses laterally against the removable flanges 210 such that the closure strip 316 pushes the removable flanges 210 into the receiving slots 322, which is shaped to prevent transverse motion of the removable flanges 210.

Figure 6C:
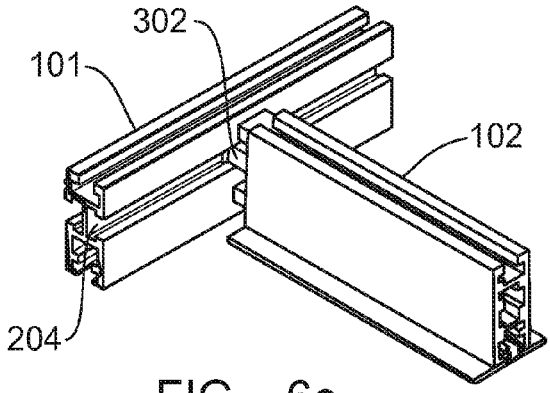
FIG. 6 is a series of perspective views of an embodiment showing progressive steps of a method for attaching a cross tee to a main tee using a cam-lock device as shown in FIGS. 6*a*, 6*b*, and 6*c;*
Figure 6B:
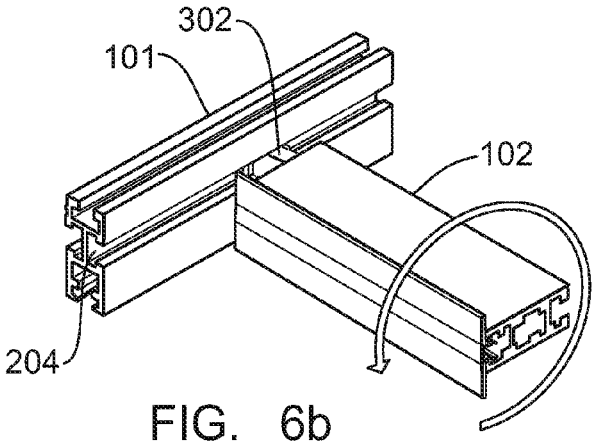
Figure 6A:
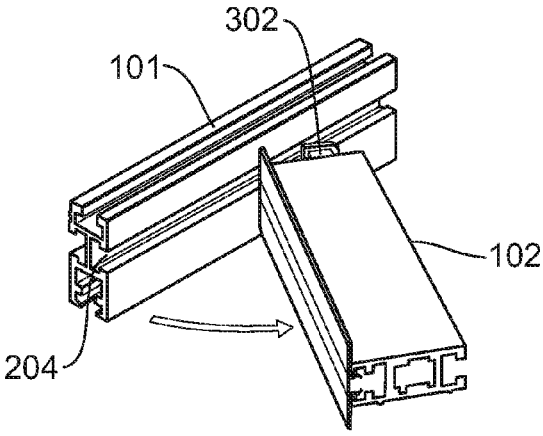

FIG. 6 is a perspective view of an embodiment of progressive steps of a method of attaching a cross tee 102 to a main tee 101 using a cam-lock device 302. First, the cross tee 102 may be positioned such that the bottom face of the cross tee 102 is in a generally vertical orientation to the main tee 101 such that the cam-lock 302 may slide into the stud receiving recessed channel 204 of the main tee 101. This is shown in FIG. 6*a*. As discussed earlier, two rounded corners 306 of the cam-lock 302 may facilitate installation. This allows the cross tee 102 with a cam-lock 302 to rotate once the cam-lock 302 is inserted in the stud receiving recessed channel 204 of main tee 101 as shown in FIG. 6*b*. Once the cross tee 102 is rotated to a position (see the arrow of FIG. 6*b*) where the bottom face of the cross tee 102 is in a horizontal orientation facing down, shown in FIG. 6*c*, the set screws may be tightened on the cross tee 102 to ensure that the cam-lock apparatus and cross tee 102 is secured against the main tee 101.

Figure 7:
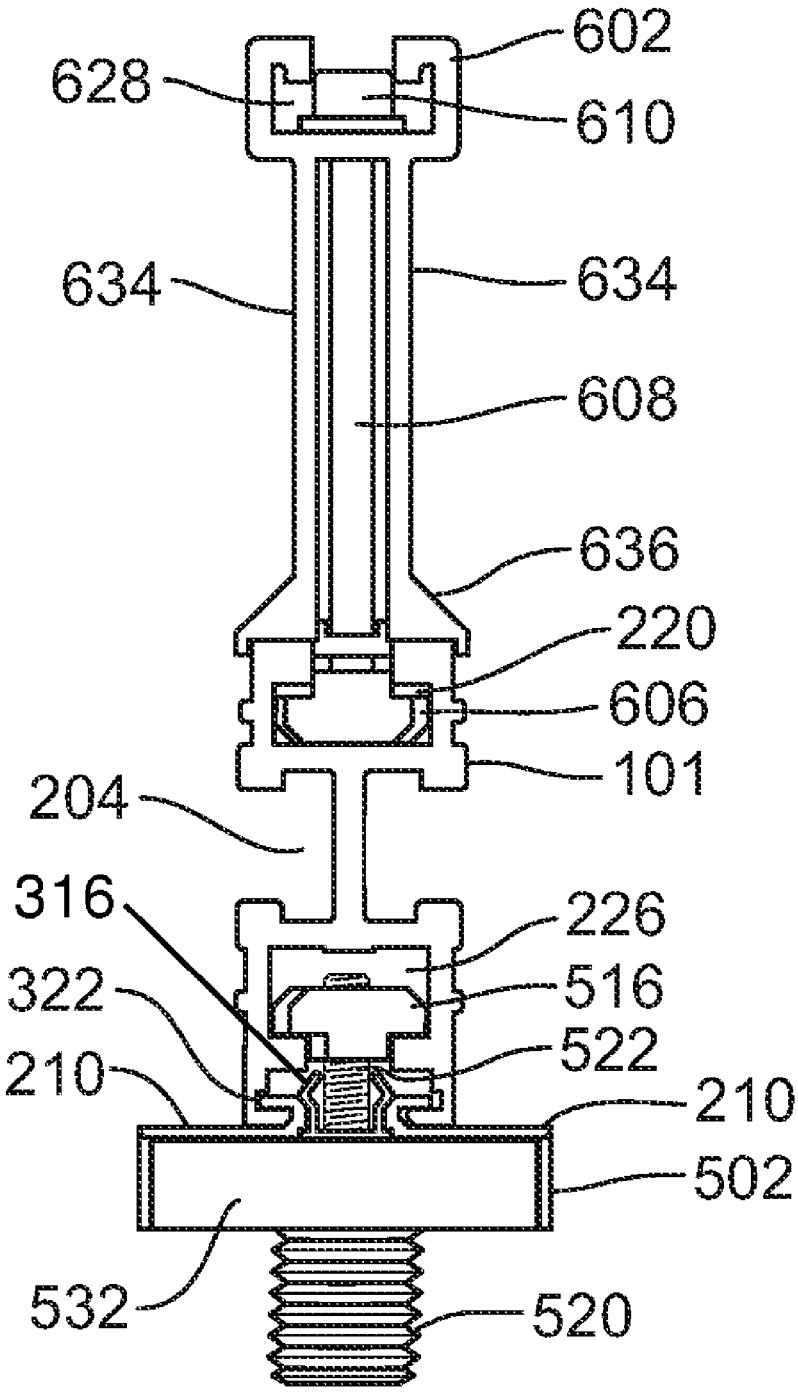
FIG. 7 is a sectional view of an embodiment of a main tee with a grid stiffener and an AMHS hanger attached.

FIG. 7 is a sectional view of an embodiment of a main tee 101 with a grid stiffener 602 and an AMHS hanger 502 attached. As in other embodiments, the main tee 101 has a top hammerhead-nut channel 220 and a bottom hammerhead-nut channel 226 as well as stud receiving recessed channels 204 in the midsection. The present embodiment also has removable flanges 210 that are inserted into their respective receiving slots in the recessed slot 322 and are held in place by a closure strip 316 that pushes against the inside walls of the removable flanges 210.

In this embodiment, the grid stiffener 602 is secured to the top of the main tee 101 and may or may not run the entire length of the main tee 101. The grid stiffener 602 is comprised of a top receiving channel 628, two studs 634, and a base 636. The grid stiffener 602 may have one or more threaded bolts 608 with heads 610 accessible in the top receiving channel 628 and hammerhead-nuts 606 attached to each threaded bolt 608 extending below the bottom of the grid stiffener 602. The hammerhead-nuts 606 are inserted into the hammerhead-nut channel 220 of the main tee 101. The threaded bolts 608 may then be tightened to ensure that the grid stiffener 602 is securely fastened to the main tee 101. This configuration of grid stiffener 602 and main tee 101 significantly increases the load-bearing capacity and minimizes bowing or deflection of the main tee 101. The grid stiffeners 602 may be strategically positioned to provide stiffening support where necessary to provide the load-bearing capabilities needed. With an increased carrying capacity, the main tees 101 may then be hung on 8'×8' centers instead of 4'×4' centers. This reduces the number of hangers and allows personnel to move easier in the interstitial space. This also allows more convenient and faster installation and maintenance of equipment.

The present embodiment also shows an AMHS hanger 502 attached to the main tee 101. The AMHS hanger 502 may have a suspension attachment such as a threaded bolt 520 suspended from the body 532 as well as one or more threaded bolts 522 extending above connected to hammerhead-nuts 516. The hammerhead-nuts 516, which are screwed onto the threaded bolts 522, may then be inserted into the bottom hammerhead-nut slot 226 of the main tee 101. The head (not shown, see FIG. 10) of the threaded bolt 522 may be recessed within the body 532 of the AMHS hanger 502 and may be accessible from the bottom of the body 532. When the threaded bolt 522 is tightened, the hammerhead-nut 516 is pulled toward the body 532 and consequently securely fastens the AMHS hanger 502 to the main tee 101.

Figure 8:
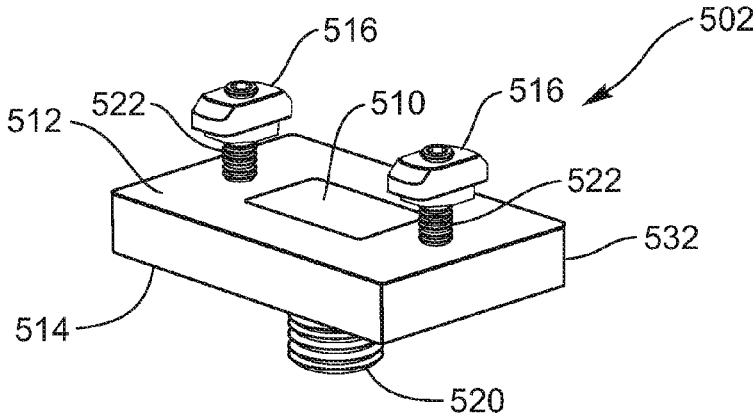
FIG. 8 is a perspective view of an embodiment of an AMHS hanger.

FIG. 8 is a perspective view of an embodiment of an AMHS hanger 502. The AMHS hanger 502 may have a threaded bolt 520 suspended from the bottom and two or more threaded bolts 522 with hammerhead-nuts 516 extending from the top. The threaded bolt 520 suspended from the body may be attached to a rectangular base 510 and the AMHS hanger base 532 may be milled on its top face 512 to receive a corresponding shape such that the top face 512 remains flush after the threaded bolt 520 and rectangular base 510 have been inserted. The heads (not shown, see FIG. 10) of two threaded bolts 522 extending above the body 532 may also be recessed into the bottom face 514 of the body 532. In an alternative embodiment, the threaded bolt base 510 and the heads of the threaded bolts 522 may not be recessed into the body 532 of the AMHS hanger 502.

Figure 9:
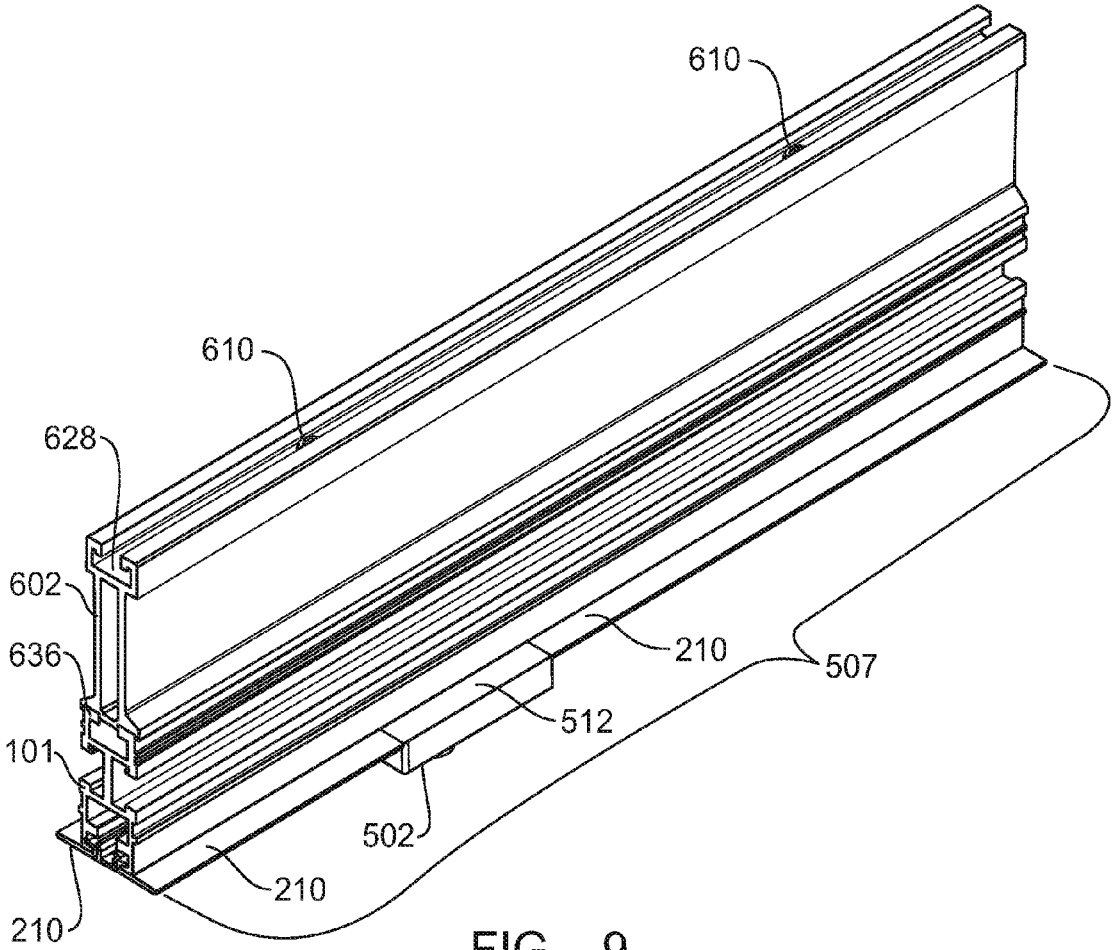
FIG. 9 is a top perspective view of an embodiment of a main tee with removable flanges, a grid stiffener and an AMHS hanger attached.

FIG. 9 is a perspective view of an embodiment of a main tee 101 with removable flanges 210 and a full-length grid stiffener 602 and an AMHS hanger 502 attached. The removable flanges 210 may not extend the entire length of the main tee 101. Instead, the removable flanges 210 may be interrupted to allow space for an AMHS hanger 502. Equipment or blank pans may then rest on the ledge 507 created by the removable flanges 210 and the top face 512 of the AMHS hanger 502. Alternatively, the removable flanges 210 may run the entire length of the main tee 101. Like other embodiments, the heads 610 of the threaded bolts 608 are accessible in the top receiving slot 628 of the grid stiffener 602. When the threaded bolts 608 are tightened, the base 636 is fastened securely to the top of the main tee 101.

Figure 10:
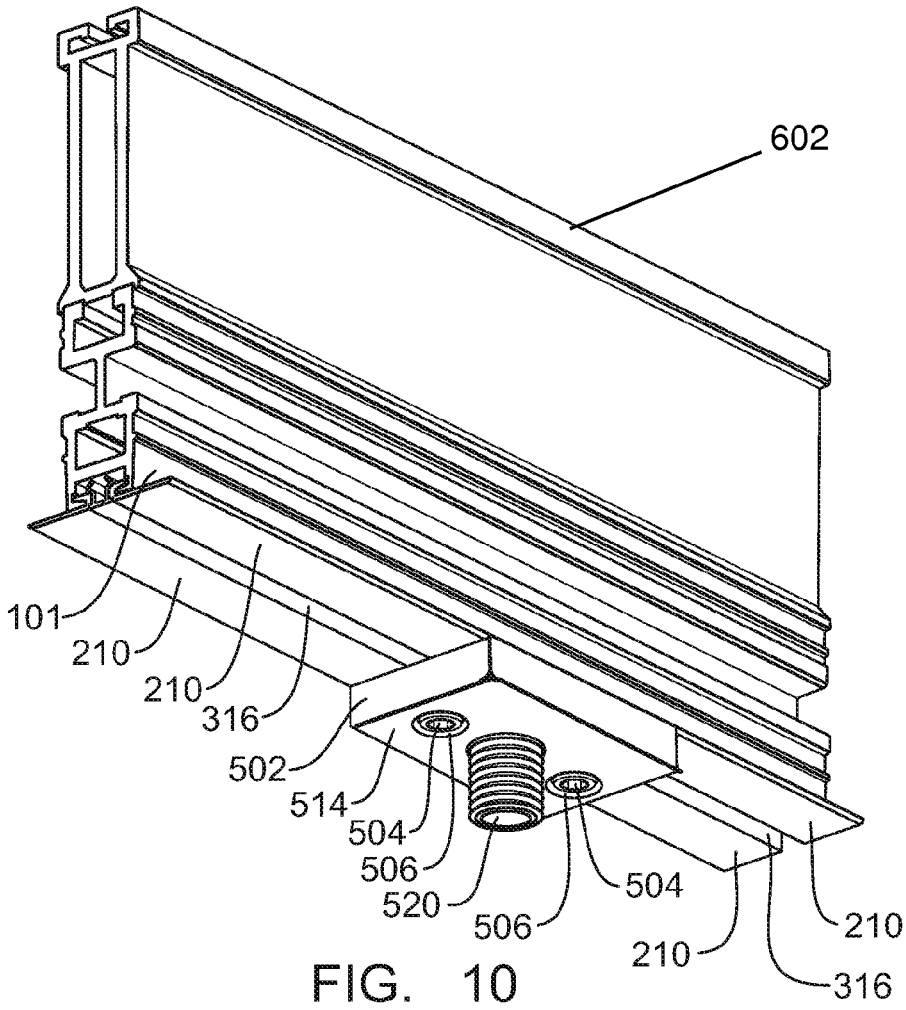
FIG. 10 is a bottom perspective view of the embodiment of FIG. 9 of a main tee with removable flanges, a grid stiffener and an AMHS hanger attached.

FIG. 10 is a bottom perspective view of another embodiment of a main tee 101 with removable flanges 210, closure strips 316, a grid stiffener 602, and an AMHS hanger 502 attached. The heads 504 of the threaded bolts 522 connecting the AMHS hanger 502 to the main tee 101 are recessed into a milled cavity 506 within the bottom face 514 of the AMHS hanger 502. There may also be a threaded bolt 520 suspended from the AMHS hanger 502 to which equipment can be attached.

Figure 11:
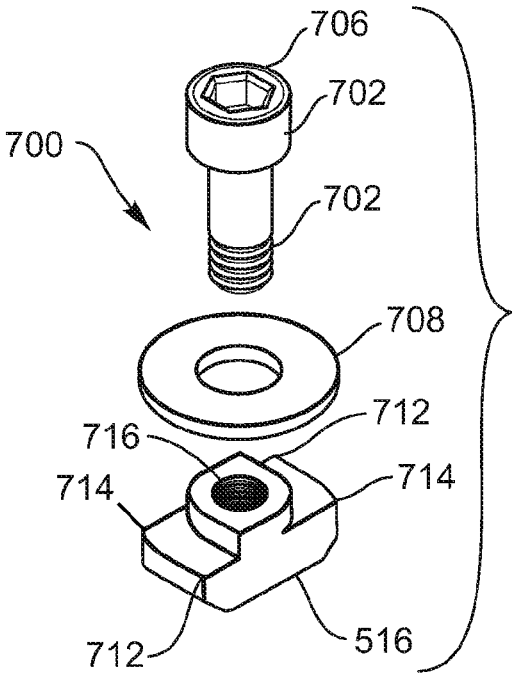
FIG. 11 is a perspective view of the embodiment of an embodiment of a hammerhead-nut assembly.

FIG. 11 is a perspective view of an exemplary embodiment of a hammerhead-nut assembly 700. In this embodiment, the bolt 702 is threaded and has a hex recess 706 for receiving a driver in the head 704. The bolt 702 may be inserted through a washer 708 and an assortment of other things (not shown) such as a portion of a tee. The end of the bolt 702 may then be threaded into the hole 716 in the hammerhead-nut 516. The hammerhead-nut may have two square corners 712 and two rounded corners 714 to aid installation. The rounded corners 714 may allow the hammerhead-nut 516 to be turned up to 90 degrees within a hammerhead-nut slot in a tee (not shown) while still restricting it from turning completely around. Thus, the hammerhead-nut 516 will be perpendicular to the tees when tightened.

Figure 12C:
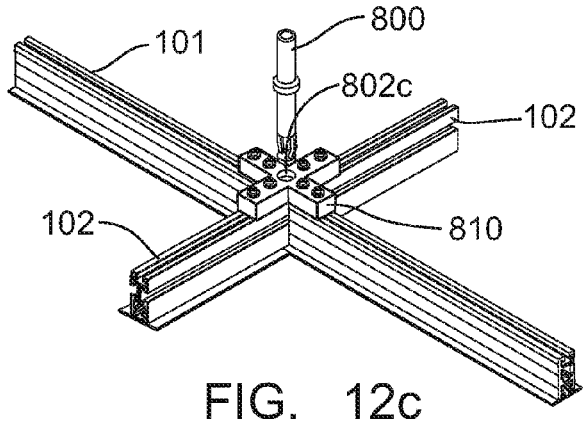
FIG. 12 is a perspective view of alternative embodiments (FIGS. 12*a*, 12*b*, and 12*c*) showing installing a sprinkler head assembly into a ceiling.
Figure 12B:
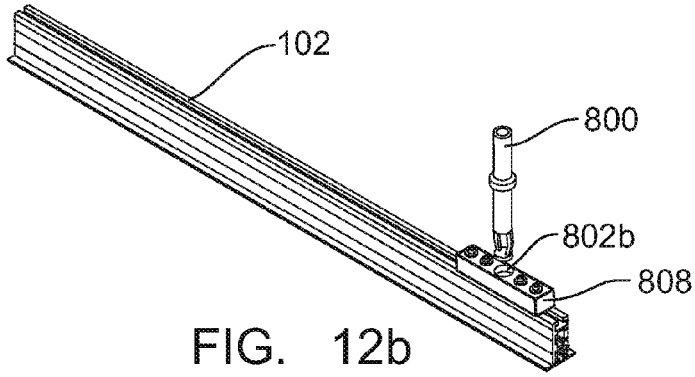
Figure 12A:
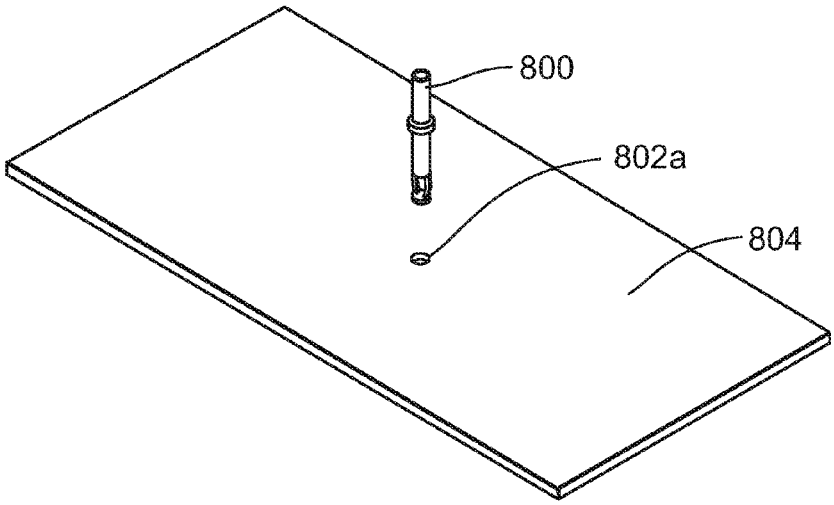

FIG. 12 is a perspective view of three embodiments for installing a sprinkler head assembly 800 into a ceiling. The sprinkler head assembly 800 may be inserted from above into a hole 802*a* drilled into a blank pan 804 (FIG. 12*a*). The assembly 800 may also be inserted into and through a cross tee 102 with a hole drilled into it. A strengthening plate 808 with a hole 802*b* may be attached to the top of the cross tee 102 with the hole 802*b* in the strengthening plate 808 aligned with the hole in the cross tee 102. The assembly 800 may then be lowered through the strengthening plate 808 and the cross tee 102. Alternatively, the assembly 800 may be lowered through an intersection plate 810 attached to the top of an intersection of a main tee 101 and one or more cross tees 102. As before, the intersection plate 810 strengthens the intersection and is attached to the main tee 101 with two or more hammerhead-nut assemblies and has a hole 802*c* that aligns above a hole in the main tee 101 through which the sprinkler head assembly may pass.

Figure 13:
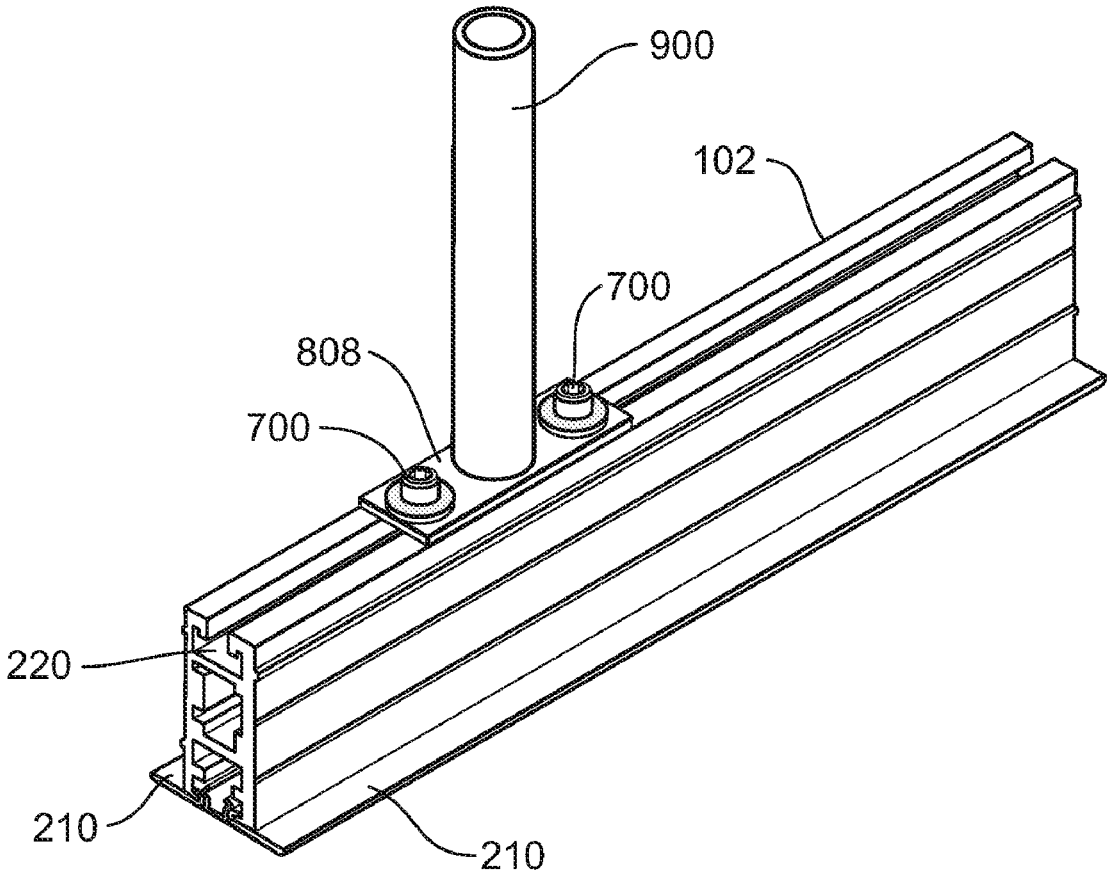
FIG. 13 is a perspective view of an embodiment of a tee with removable flanges and a conduit drop attached.

FIG. 13 is a perspective view of an embodiment of a cross tee 102 with removable flanges 210 and a conduit drop 900 attached. The cross tee 102 may have a hole drilled from the top to bottom (not shown). The top of the cross tee 102 may also have a strengthening plate 808 attached with two or more hammerhead-nut assemblies 700. The hammerhead-nuts may be inserted into the top hammerhead-nut slot 220 and then tightened to ensure that the strengthening plate 808 is securely fastened to the top of the cross tee 102. The strengthening plate 808 may have a hole that is aligned with the hole in the cross tee 102. A conduit drop 900 may then be inserted through the hole in the plate 808 such that access is provided from the top of the cross tee 102 to the bottom of the cross tee 102 through the conduit drop 900.

The scope of this invention is not limited to the above-described preferred embodiment. The terms and expressions used are terms of description and there is no intention of excluding any equivalents of the features shown and described, but it is recognized that various modifications, appreciable to one of ordinary skill, are possible within the scope of the invention claimed.

What is claimed:

1. A bottom-load suspended ceiling system to support ceiling panels and carry loads, the ceiling system suspended from suspension anchors, the ceiling system comprising:

a plurality of main frame members, each main frame member comprising a body having a top receiving channel, a bottom receiving channel, at least one lateral receiving channel, and a panel support ledge, the panel support ledge comprising at least one removable flange to be restrained from transverse movement by a closure strip; and a plurality of cross frame members having at least one panel support ledge, each cross frame member connected to at least one lateral receiving channel of the main frame member; and one of the at least one removable flanges is adapted to be removed to permit bottom-loading of one of the ceiling panels and adapted to be repositioned to support the ceiling panel.

2. The ceiling system according to claim 1 in which the top receiving channel of the main frame member accepts hammerhead-nuts.

3. The ceiling system according to claim 1 in which the bottom receiving channel of the main frame member accepts hammerhead-nuts.

4. The ceiling system according to claim 1 in which at least one structural stiffener is attached to the top receiving channel of the main frame member.

5. The ceiling system according to claim 1 in which at least one AMHS hanger is attached to the bottom receiving channel of the main frame member.

6. The ceiling system according to claim 1 in which at least one splice bar connects main frame members.

7. The ceiling system according to claim 1 in which at least one splice bar connects cross frame members.

8. The ceiling system according to claim 1 in which a body of at least one main frame member has an inverted T-shape.

9. The ceiling system according to claim 1 in which a body of at least one main frame member has an I-shape.

10. The ceiling system according to claim 1 in which members form a lattice configuration wherein the main frame members are suspended using suspension anchors on 8 foot centers.

11. The ceiling system according to claim 1 in which the frame members comprise extruded aluminum.

12. A suspended ceiling system to support ceiling panels and carry loads, the ceiling system suspended from suspension anchors, the ceiling system comprising:

a plurality of main frame members, each main frame member comprising a body having a top receiving channel, a bottom receiving channel, at least one lateral receiving channel, and a panel support ledge, the panel support ledge comprising at least one removable flange to be restrained from transverse movement by a closure strip;

a plurality of cross frame members having at least one panel support ledge, each cross frame member connected to at least one lateral receiving channel of the main frame member; and an AMHS hanger for insertion into the bottom receiving channel of at least one of the main frame members, the AMHS hanger having a suspension attachment;

one of the at least one removable flanges is adapted to be removed to permit bottom-loading of one of the ceiling panels and adapted to be repositioned to support the ceiling panel.

13. A ceiling system according to claim 12 further comprising a structural stiffener.

14. A ceiling system according to claim 13 wherein the AMHS hanger subtends the structural stiffener.

15. A ceiling system according to claim 12 wherein a cam-lock member is used to connect at least one cross frame member to at least one main frame member.

* * * * *